US012529217B2

(12) United States Patent
Li et al.

(10) Patent No.: US 12,529,217 B2
(45) Date of Patent: Jan. 20, 2026

(54) SHOWER HEAD FIXING STRUCTURE

(71) Applicant: Xiamen EASO Co.,Ltd., Xiamen (CN)

(72) Inventors: Zhen Li, Xiamen (CN); Haitao Lu, Xiamen (CN); Jiang Jiao, Xiamen (CN)

(73) Assignee: Xiamen EASO Co., Ltd., Xiamen (CN)

( * ) Notice: Subject to any disclaimer, the term of this patent is extended or adjusted under 35 U.S.C. 154(b) by 223 days.

(21) Appl. No.: 18/211,309

(22) Filed: Jun. 19, 2023

(65) Prior Publication Data

US 2023/0407613 A1 Dec. 21, 2023

(30) Foreign Application Priority Data

Jun. 20, 2022 (CN) ..... 202210694952.2

(51) Int. Cl.
*E03C 1/06* (2006.01)

(52) U.S. Cl.
CPC ..... *E03C 1/06* (2013.01)

(58) Field of Classification Search
CPC ..... E03C 1/06; E03C 1/08
See application file for complete search history.

(56) References Cited

U.S. PATENT DOCUMENTS

| | | | | |
|---|---|---|---|---|
| 10,822,778 | B1 * | 11/2020 | Ling | E03C 1/06 |
| 12,042,807 | B2 * | 7/2024 | Shade | B05B 1/18 |
| 2020/0360955 | A1 * | 11/2020 | Huang | B05B 15/68 |

* cited by examiner

*Primary Examiner* — Christine J Skubinna
(74) *Attorney, Agent, or Firm* — Jose Cherson Weissbrot

(57) ABSTRACT

A shower head fixing structure includes a valve seat assembly and a shower head body. A clamping groove is disposed on the valve seat assembly; a fixing apparatus clamped with the clamping groove is disposed on the shower head body; the fixing apparatus includes a sliding member and a fixing arm; the fixing arm can be clamped in the clamping groove; the sliding member is capable of moving to drive the fixing arm to rotate, enabling the fixing arm to clamp the shower head body; the fixing apparatus further includes a spring capable of driving the fixing arm to move towards the clamping groove. The shower head fixing structure is provided with a self-locking structure, and a shower head is not easy to fall off after being fixed.

17 Claims, 16 Drawing Sheets

SHOWER HEAD FIXING STRUCTURE

CROSS REFERENCE TO THE RELATED APPLICATIONS

This application is based upon and claims priority to Chinese Patent Application No. 202210694952.2, filed on Jun. 20, 2022, the entire contents of which are incorporated herein by reference.

TECHNICAL FIELD

The present invention relates to a shower head fixing structure.

BACKGROUND

A shower device, especially a shower head, has become necessary for our daily life. An existing shower head is generally mounted on a socket during use, and is inconvenient to pick and place. In addition, a magnetic shower head is easy to fall off especially when an angle needs to be adjusted, and is easy to cause water leakage.

SUMMARY

In order to solve the above technical problems, the objective of the present invention is to provide a shower head fixing structure.

The present invention is implemented by the following technical solution:

A shower head fixing structure, including a valve seat assembly and a shower head body, wherein a clamping groove is disposed on the valve seat assembly; a fixing apparatus clamped with the clamping groove is disposed on the shower head body; the fixing apparatus includes a sliding member and a fixing arm hinged to the shower head body; one side end of the fixing arm is capable of being clamped in the clamping groove, and a drive end on the other side operates in cooperation with the sliding member; the sliding member is capable of moving to drive the fixing arm to rotate, enabling the fixing arm to clamp the shower head body; the fixing apparatus further includes a spring capable of driving the fixing arm to move towards the clamping groove.

In one embodiment of the present invention, a convex teeth are disposed at one end of the sliding member; the convex teeth are a gear rack disposed on the sliding member; a concave teeth are disposed on the fixing arm; the concave teeth are a gear disposed on the fixing arm; the gear is fixedly connected to the fixing arm; a center of the gear and a hinge point of the fixing arm are located on the same axial line; the gear rack is cooperatively connected to the gear; and the gear rack is capable of moving to drive the fixing arm provided with the gear to rotate.

In one embodiment of the present invention, the spring is located between the sliding member and the shower head body or between the fixing arm and the shower head body or between two fixing arms.

In one embodiment of the present invention, the fixing apparatus further includes a push button for driving the sliding member to move; the push button is cooperatively connected to a linkage member; the linkage member is cooperatively connected to the sliding member; and the push button is capable of pushing the sliding member to move.

In one embodiment of the present invention, the fixing arms are a pair; the pair of fixing arms are distributed on two sides of the gear rack; a pin shaft is disposed on the shower head body located on two sides of the gear rack; the fixing arm is sleeved on the pin shaft, and rotates around the pin shaft; a first guide inclined surface is disposed at one side end of the fixing arm distal from the pin shaft; a second guide inclined surface is disposed at one end of the valve seat assembly facing the shower head body; the first guide inclined surface is capable of being cooperatively connected to the second guide inclined surface; a first magnetic element is disposed on the shower head body; and a second magnetic element capable of being cooperatively connected to the first magnetic element is disposed on the valve seat assembly.

In one embodiment of the present invention, the valve seat assembly includes a valve seat and a spherical joint which are cooperatively connected; a spherical portion at one end of the spherical joint is cooperatively connected to the valve seat, and a connecting portion at the other end of the spherical joint is provided with a first connecting ring and a second connecting ring; the second connecting ring is located between the first connecting ring and the spherical portion; and the clamping groove is formed between the first connecting ring and the second connecting ring.

In one embodiment of the present invention, the second guide inclined surface is disposed at one end of the first connecting ring facing the shower head body; and the second magnetic element is disposed in the middle of the first connecting ring.

In one embodiment of the present invention, an insertion hole is disposed on the shower head body; the fixing apparatus is disposed in the insertion hole; the connecting portion of the spherical joint can be inserted into the insertion hole; an outer diameter of the first connecting ring is not greater than a caliber of the insertion hole; and the first magnetic element is disposed on a bottom surface of the insertion hole.

In one embodiment of the present invention, a rubber washer is disposed on the periphery of the insertion hole; when the shower head body is fixedly connected to the valve seat assembly, the rubber washer is capable of tightly fitting with the valve seat assembly; the rubber washer includes a rubber ring; a connector clip is disposed at one end surface of the rubber ring facing the shower head body; an annular groove is disposed on the connector clip; the connector clip is capable of being inserted into the insertion hole disposed on the shower head body; the annular groove is capable of being clamped on a peripheral wall of the insertion hole; a first inclined surface is disposed at the other end surface of the rubber ring opposite to the shower head body; and a second inclined surface capable of tightly fitting with the first inclined surface is disposed on the second connecting ring.

In one embodiment of the present invention, the valve seat includes a waterway and a mounting space which are not in communication; and the spherical portion of the spherical joint is connected to the valve seat by means of an open ring and a lock nut.

In one embodiment of the present invention, a pair of sliding grooves with openings facing the valve seat assembly are disposed at an upper end of the linkage member; a pair of sliding bars corresponding to the positions of the pair of sliding grooves are disposed at a lower end of the sliding member; and the pair of sliding bars are respectively in slide fit with the pair of sliding grooves.

The shower head fixing structure of the present invention has the following beneficial effects: 1. The structure is simple, and the hand feeling is good when the shower head is fixed under the guide of the magnetic element. 2. The shower head can be adjusted up or down on the valve seat, so as to implement different water outlet directions to be applicable to people of different heights; furthermore, water does not pass through the spherical joint, thereby avoiding the water leakage phenomenon. 3. A self-locking structure is implemented by means of the spring, and the fixed shower head is not easy to fall off in combination with the sliding stepless push button.

BRIEF DESCRIPTION OF THE DRAWINGS

In order to more clearly describe the technical solution of the present invention, the accompanying drawings required for describing the embodiments or the prior art are briefly introduced hereinafter. Obviously, the accompanying drawings described below are merely some embodiments of the present invention, and a person skilled in the art may obtain other drawings according to the accompany drawings without requiring the exercise of inventive effort.

DETAILED DESCRIPTION OF THE EMBODIMENTS

Figure 1:
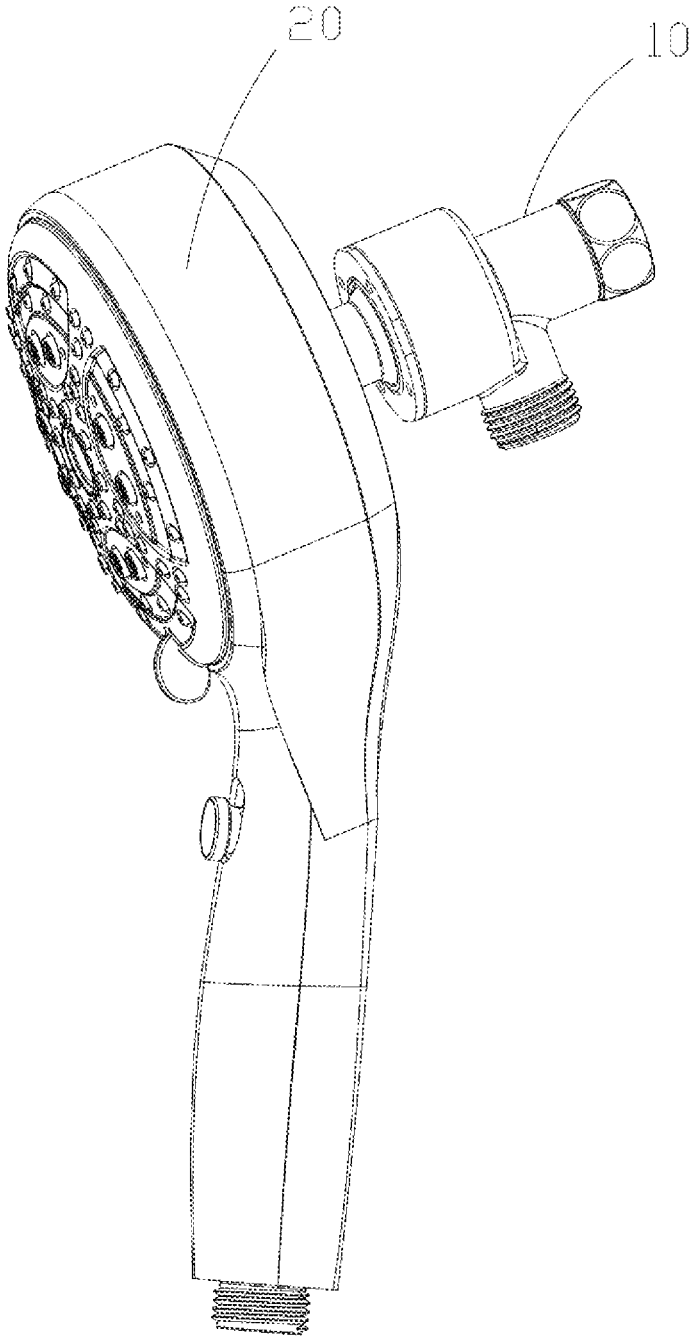
FIG. 1 is a schematic view of the present invention in a first state.
Figure 2:
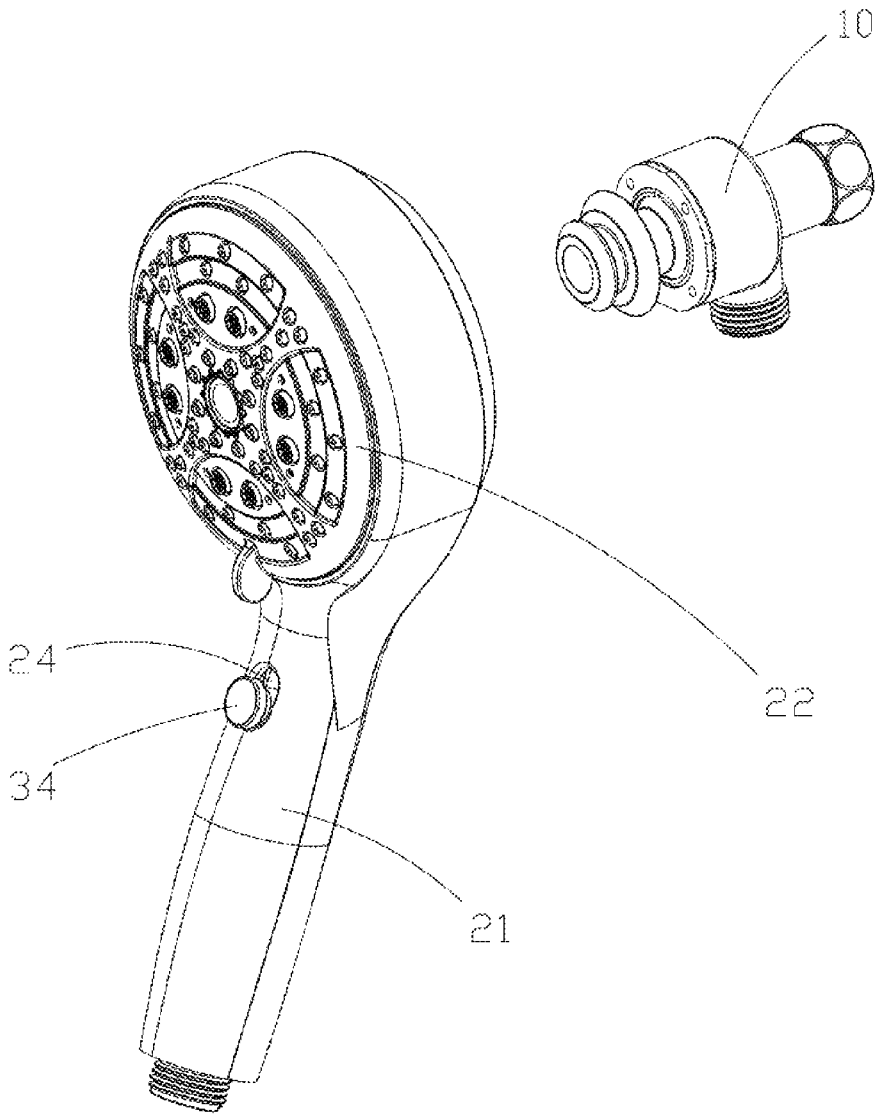
FIG. 2 is a schematic view of the present invention in a second state.
Figure 3:
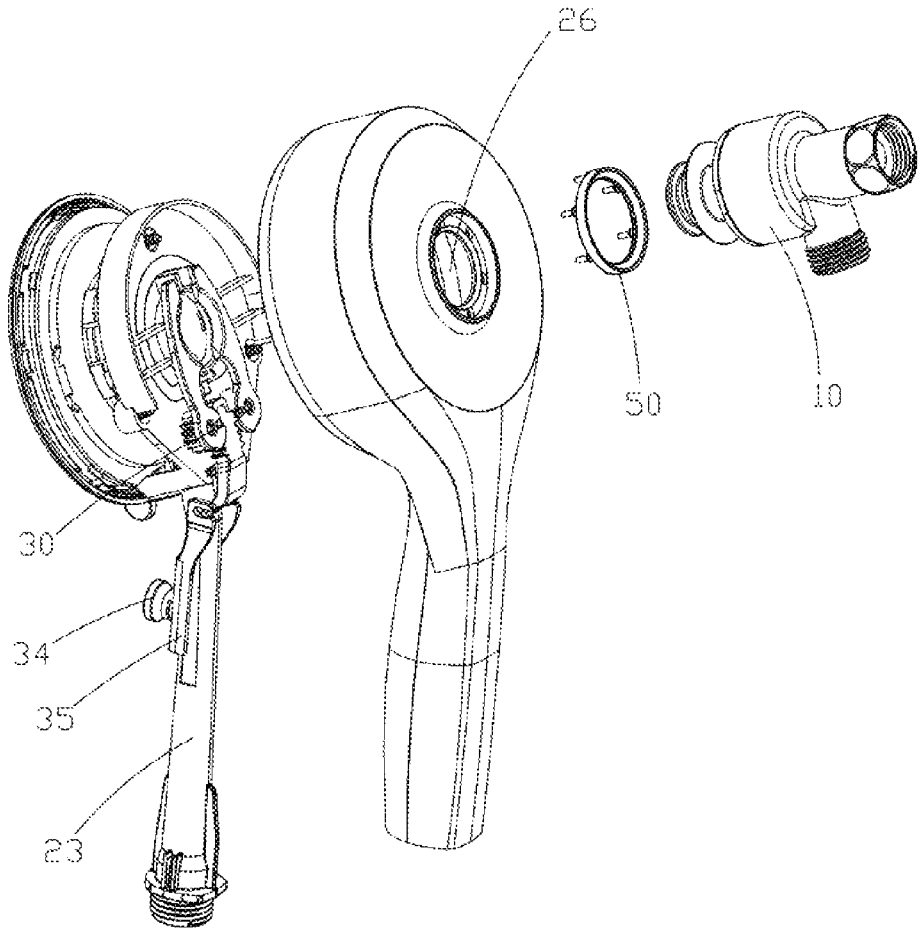
FIG. 3 is an exploded view of the present invention.

In order to make the objectives, technical solutions, and advantages of the embodiments of the present invention clearer, the technical solutions in the embodiments of the present invention will be clearly and completely described hereafter with reference to the accompanying drawings in the embodiments of the present invention. Apparently, the described embodiments are only some rather than all of the embodiments of the present invention. All the other embodiments obtained by a person skilled in the art on the basis of the embodiments of the present invention without requiring the exercise of inventive effort are all concluded in the scope of protection of the present invention. Therefore, the detailed description for the embodiments of the present invention in the accompanying drawings is not intended to limit the claimed scope of protection, but merely denotes the selected embodiments of the present invention. All the other embodiments obtained by a person skilled in the art on the basis of the embodiments of the present invention without requiring the exercise of inventive effort are all concluded in the scope of protection of the present invention.

In the descriptions of the present invention, it should be understood that the azimuth or position relationships indicated by the terms "center", "longitudinal", "transverse", "length", "width", "thickness", "upper", "lower", "front", "rear", "left", "right", "vertical", "horizontal", "top", "bottom", "inner", "outer", "clockwise", "anticlockwise", etc. are on the basis of the azimuth and position relationships as shown in the drawings, and are only intended to facilitate and simplify the description of the present invention, but not intended to indicate or imply that the designated devices or elements must have a specific azimuth or are constructed and operated in a specific azimuth. Therefore, the terms cannot be considered to limit the present invention.

In addition, the terms "first" and "second" are used for the purpose of description only, but cannot be considered to indicate or imply relative importance or implicitly indicate the number of the indicated technical features. Therefore, the feature defined by "first" or "second" may explicitly or implicitly include one or more features. In the description of the present invention, "a plurality of" means two or more, unless otherwise specifically defined.

In the present invention, unless otherwise stated or defined, the terms "mount", "connected", "connect", "fix" and the like should be understood in a broad sense, for example, the term "connected" may be fixedly connected or detachably connected or integrally connected, may be mechanically connected or electrically connected, may be directly connected or indirectly connected by means of an intermediate medium, and may be internally communicated or have an interaction relationship between two elements. A person skilled in the art may understand the specific meanings of the above terms in the present invention according to specific circumstances.

In the present invention, unless otherwise stated or defined, that a first feature is "above" or "below" a second feature may include that the first feature and the second feature are in direct contact, and may also include that the first feature and the second feature are not in direct contact but in contact by means of another feature therebetween. Moreover, that the first feature is "above", "on" and "over" the second feature includes that the first feature is over or above the second feature, or only indicates that the horizontal height of the first feature is higher than that of the second feature. That the first feature is "below", "under" and "beneath" the second feature includes that the first feature is under or below the second feature, or only indicates that the horizontal height of the first feature is lower than that of the second feature.

With reference to the drawings of the description, a shower head fixing structure, including a valve seat assembly 10 and a shower head body 20, wherein a clamping groove 11 is disposed on the valve seat assembly; a fixing apparatus 30 clamped with the clamping groove is disposed on the shower head body; the fixing apparatus includes a sliding member 31 and a fixing arm 32 hinged to the shower head body; in one use, the fixing arms are a pair, so as to form a clamp form; when the shower head is fixed to the valve seat assembly, the two fixing arms are clamped in the clamping groove; one side end of the fixing arm is capable of being clamped in the clamping groove, and a drive end on the other side operates in cooperation with the sliding member; the sliding member is capable of moving to drive the fixing arm to rotate, enabling the fixing arm to clamp the shower head body; the fixing apparatus further includes a spring 33 capable of driving the fixing arm to move towards the clamping groove; that is, the fixing arm is in a clamped state all the time under the action of the spring without an external force.

Figure 12:
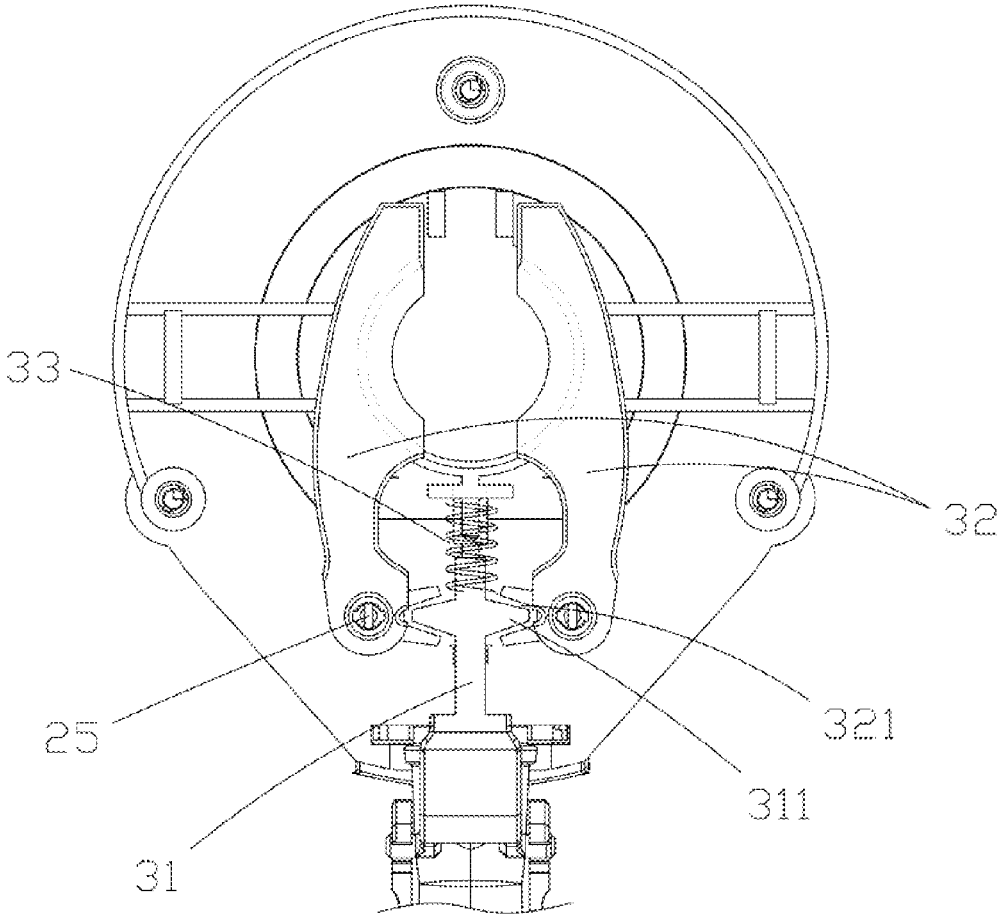
FIG. 12 is a first schematic view according to one embodiment of the present invention.

Specifically, with reference to the FIG. 12, a convex teeth 311 are disposed at one end of the sliding member; a concave teeth 321 are disposed on the fixing arm; the convex teeth and the concave teeth are cooperatively connected; and the convex teeth are capable of moving to drive the fixing arm provided with the concave teeth to rotate. Specifically, with reference to the FIGS. 4 and 13, in one embodiment, the convex teeth may be a gear rack 311' disposed on the sliding member; the concave teeth are a gear disposed on the fixing arm; the gear is fixedly connected to the fixing arm; a center of the gear and a hinge point of the fixing arm are located on the same axial line; the gear rack is cooperatively connected to the gear. In the present invention, the two fixing arms are folded and unfolded by moving the sliding member; when the fixing arms are unfolded, the shower head body may move freely; and when the fixing arms are folded, the two fixing arms are clamped in the clamping groove in which case the shower head body is fixed to the valve seat assembly.

Figure 4:
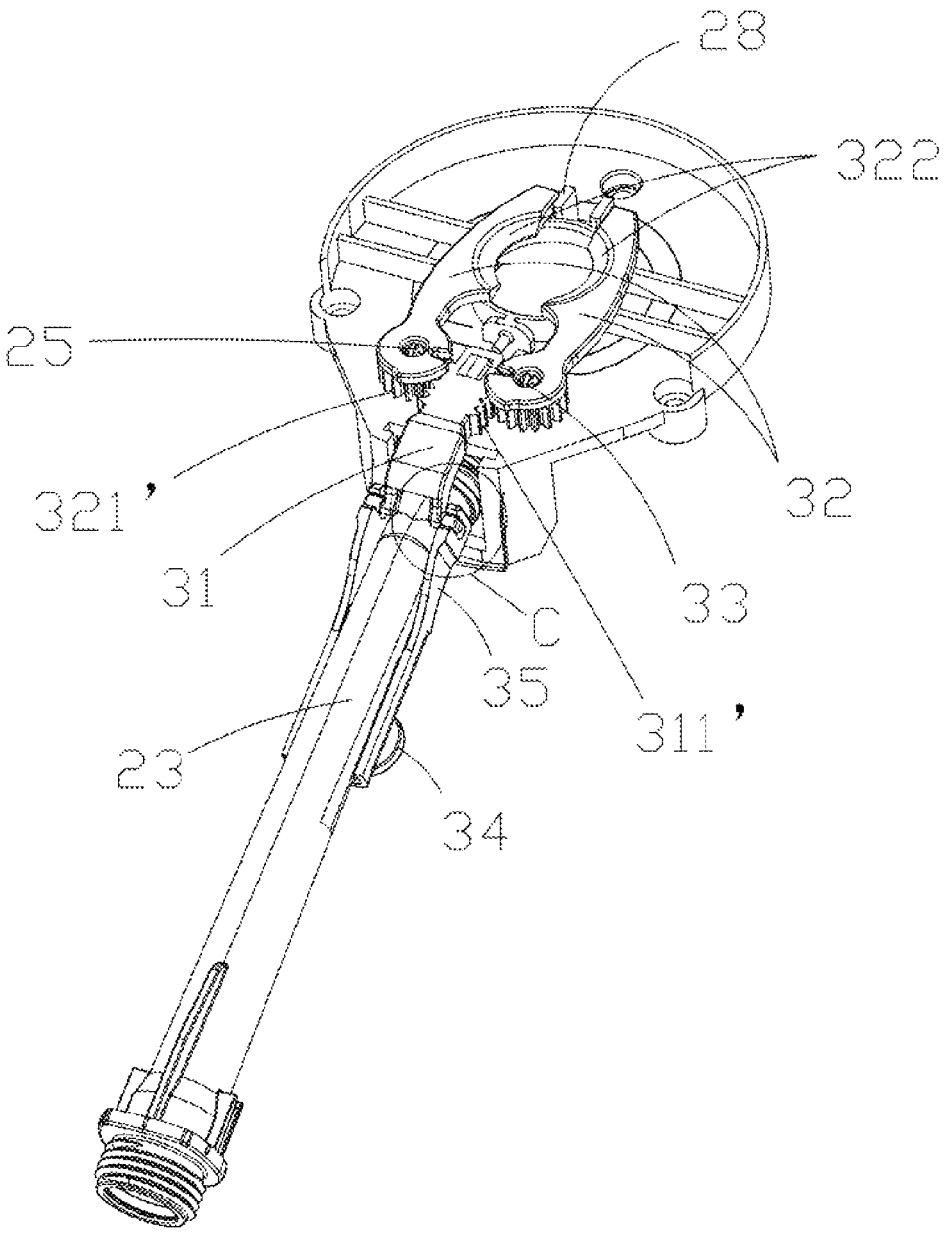
FIG. 4 is a schematic view of the fixing apparatus according to the present invention.
Figure 5:
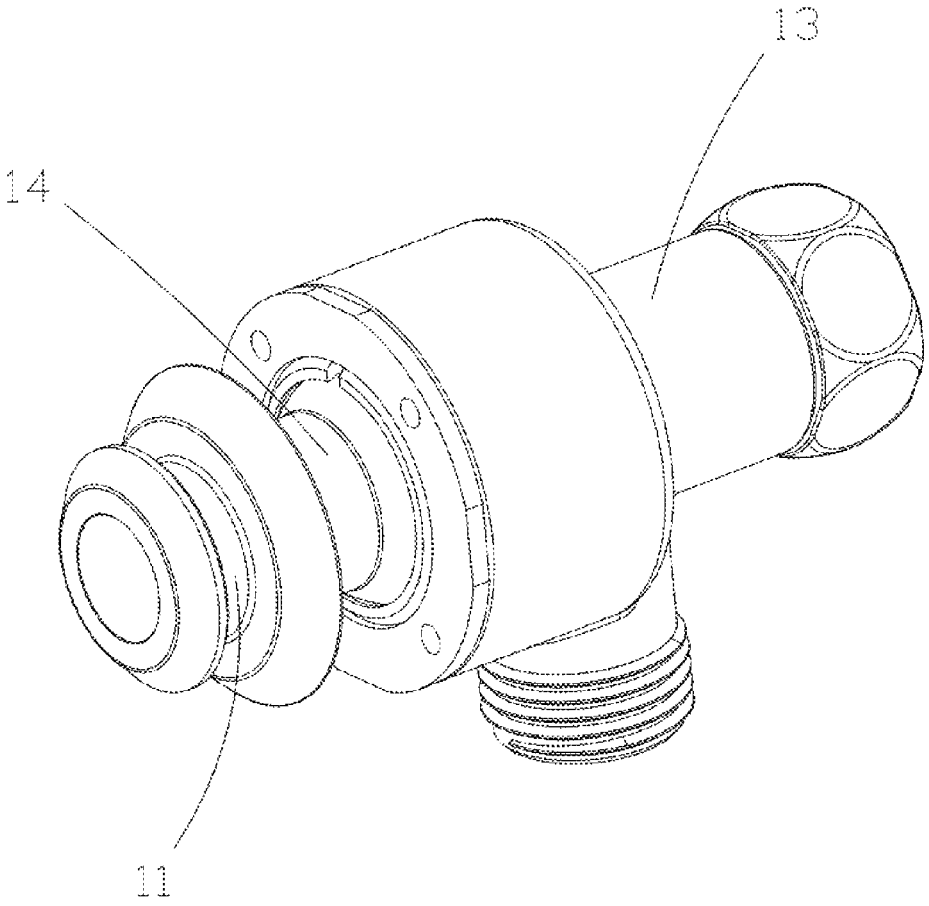
FIG. 5 is a schematic view of the valve seat assembly according to the present invention.
Figure 6:
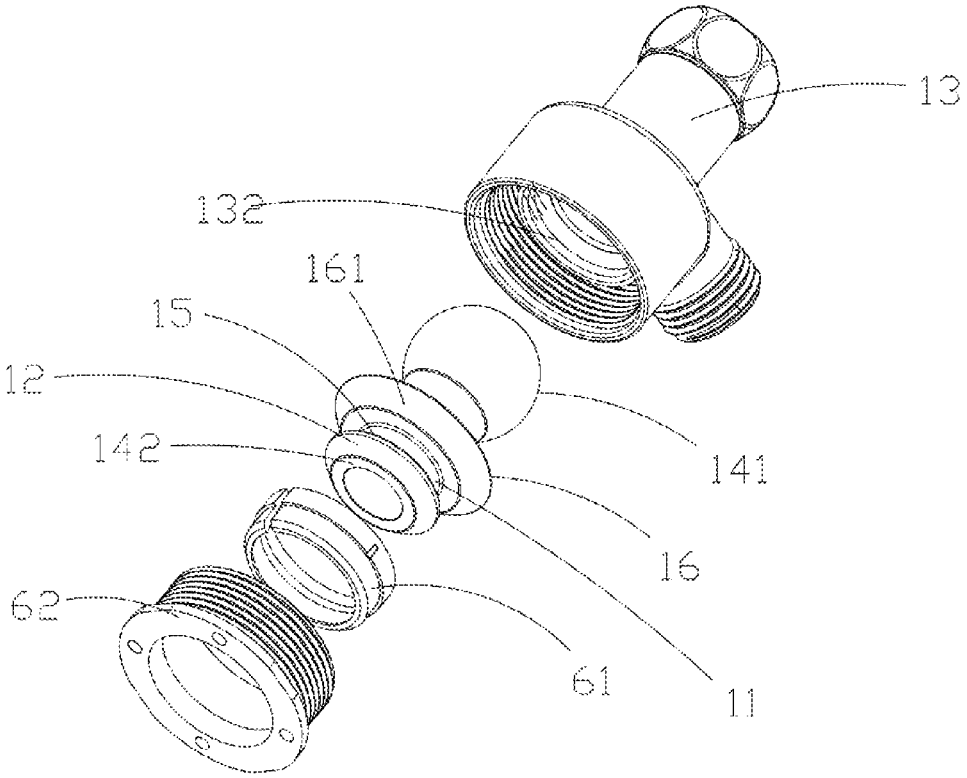
FIG. 6 is an exploded view of the valve seat assembly according to the present invention.
Figure 7:
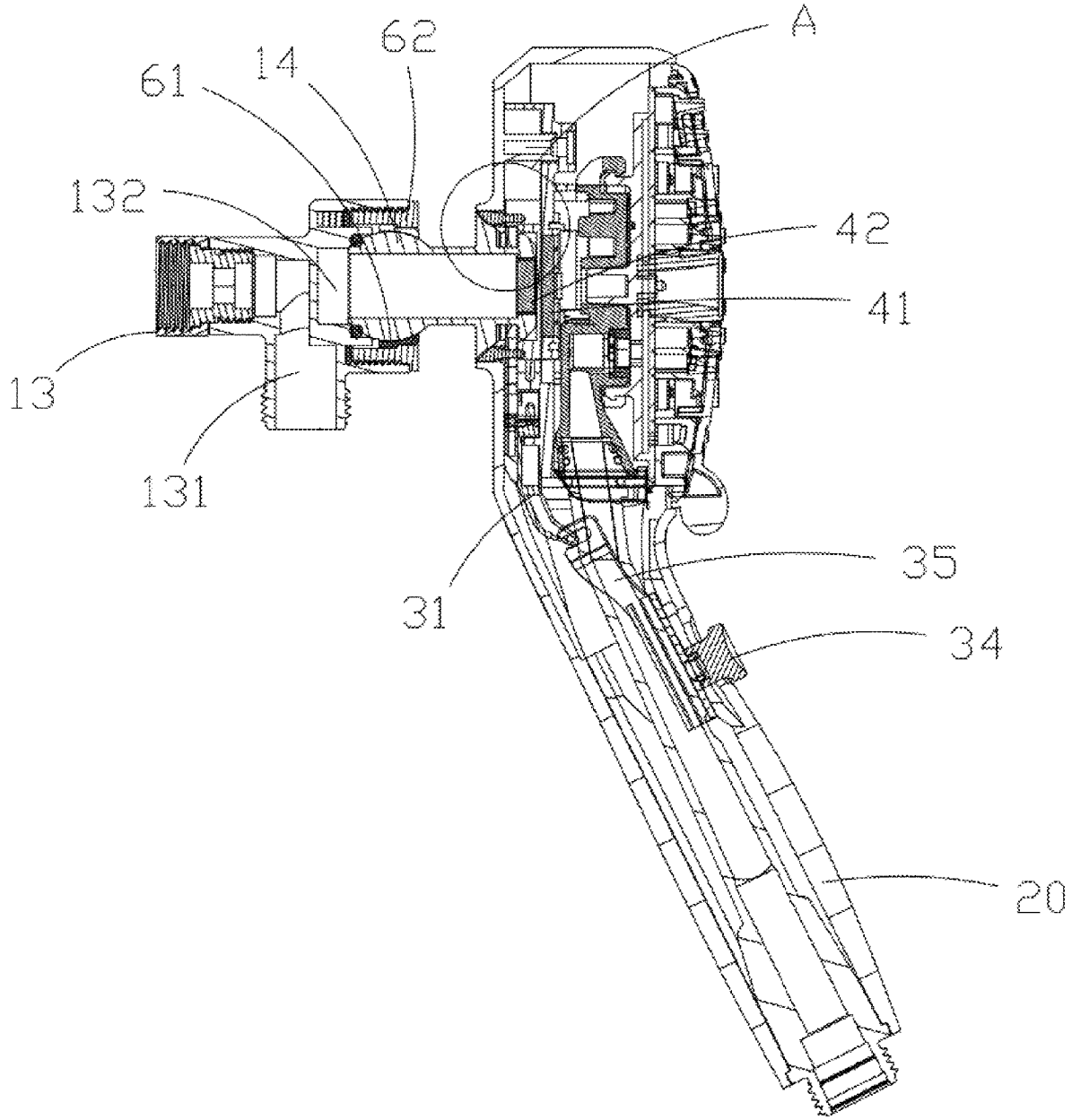
FIG. 7 is a first sectional view of the present invention.
Figure 8:
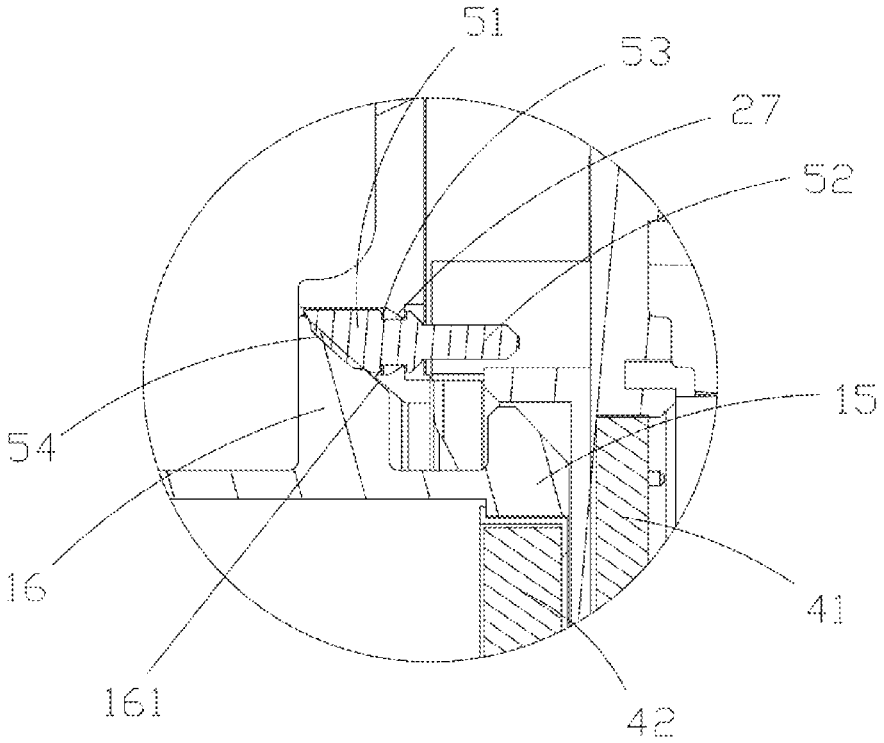
FIG. 8 is an enlarged view of A in FIG. 7.
Figure 9:
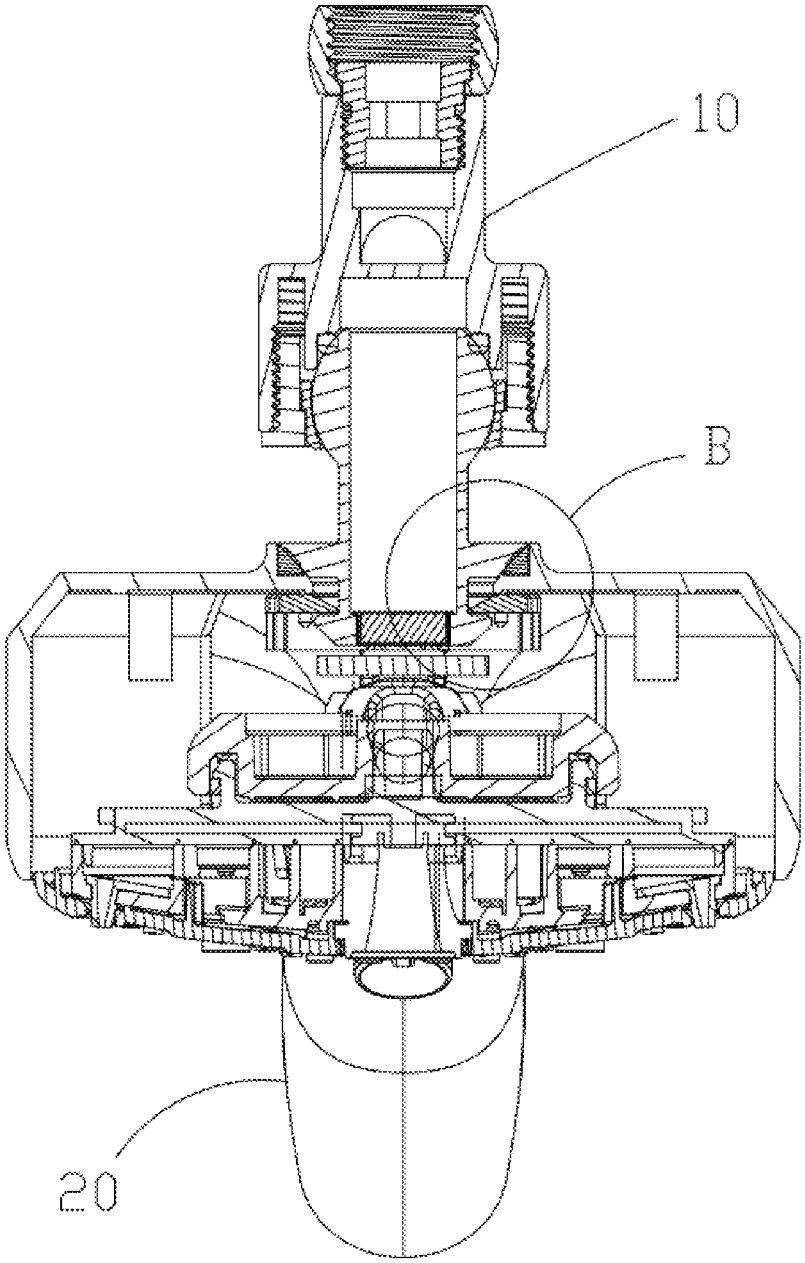
FIG. 9 is a second sectional view of the present invention.
Figure 10:
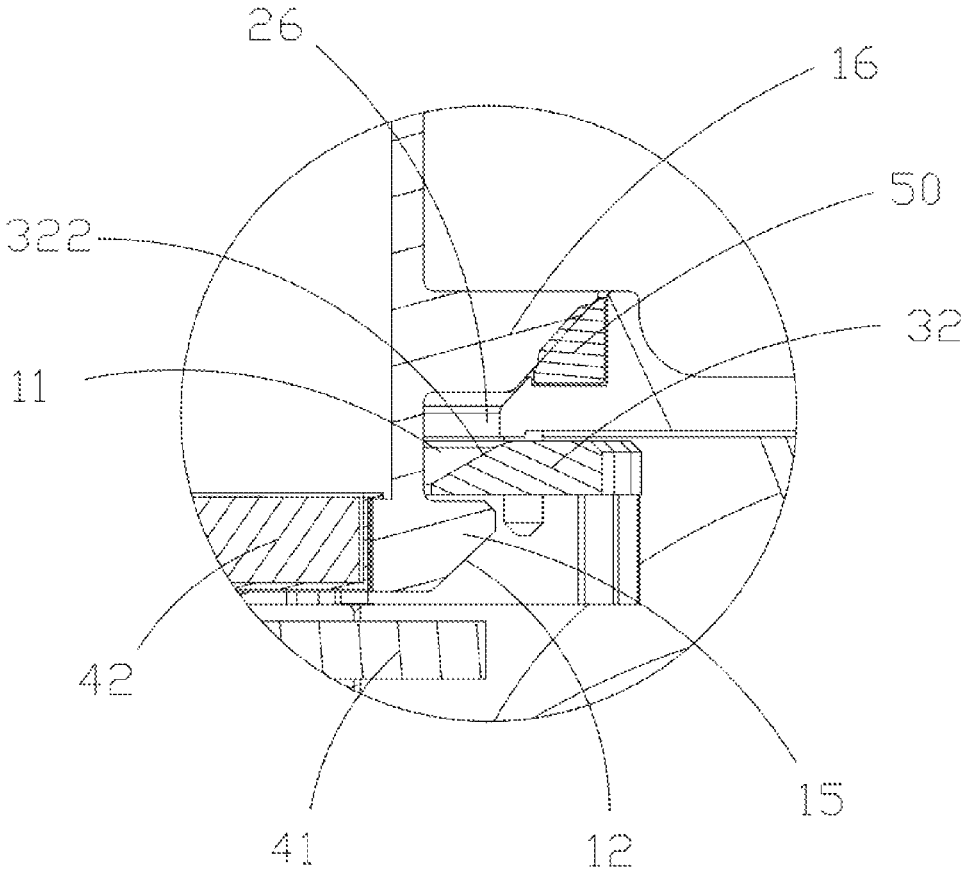
FIG. 10 is an enlarged view of B in FIG. 8.
Figure 11:
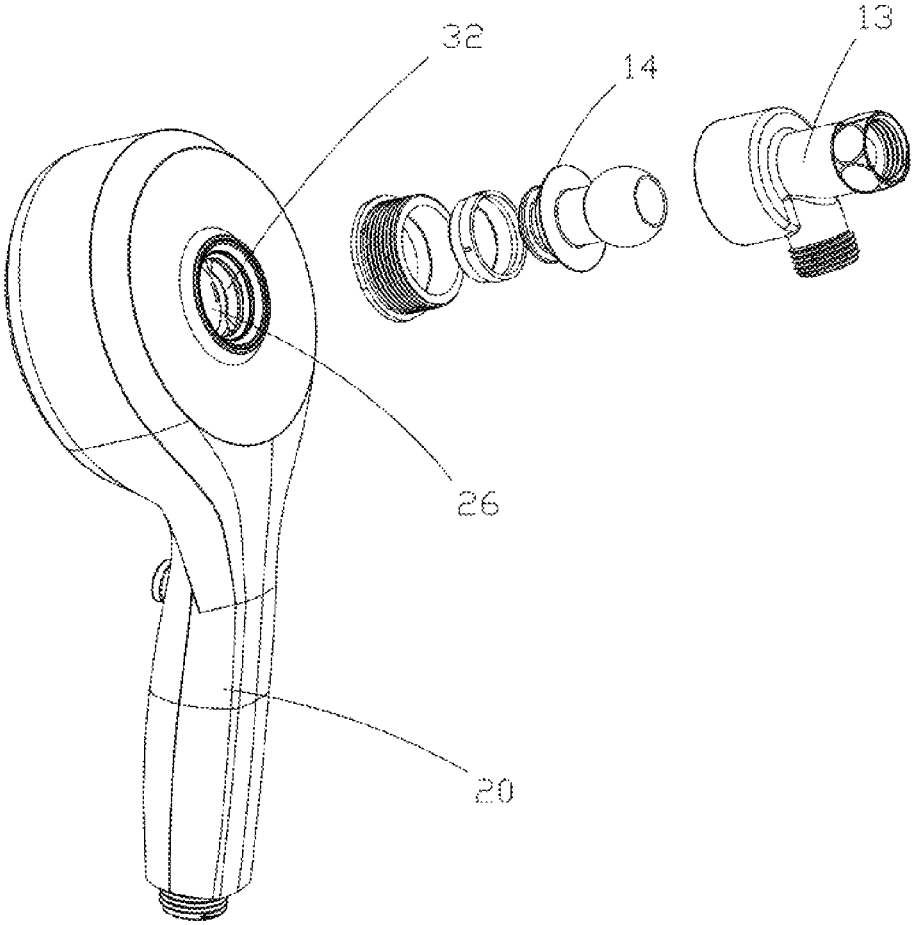
FIG. 11 is another exploded view of the present invention.
Figure 13:
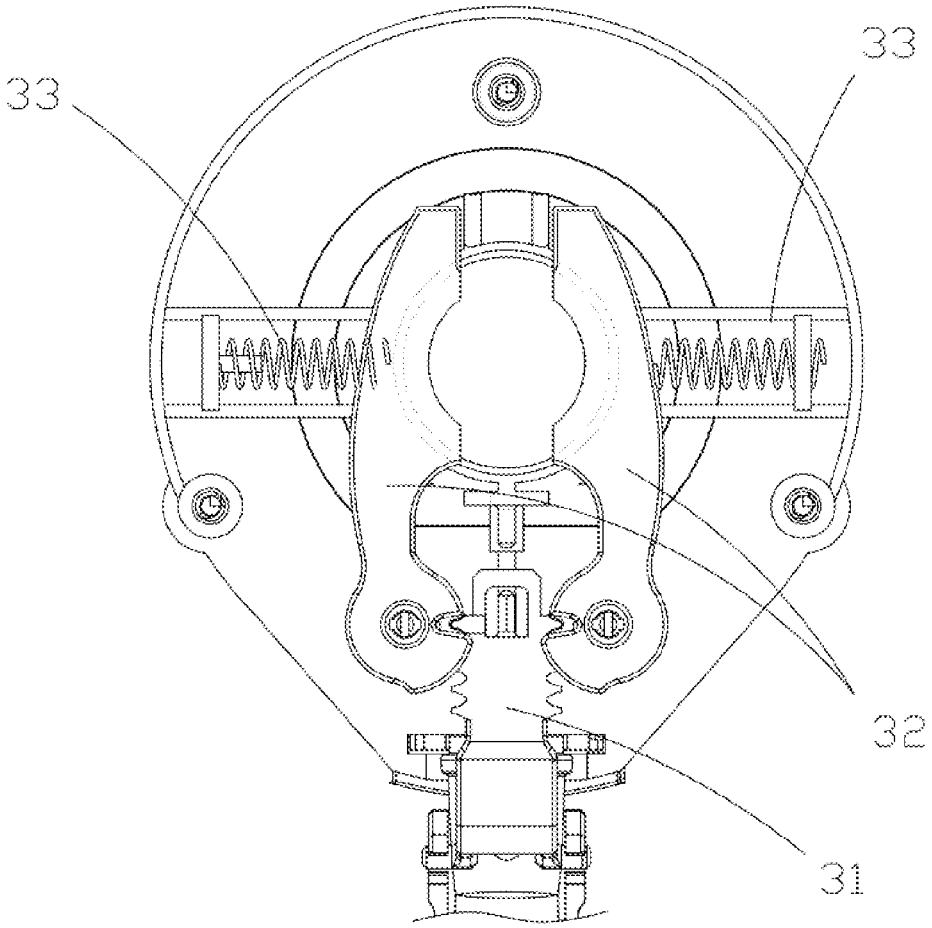
FIG. 13 is a second schematic view according to another embodiment of the present invention.

Still further, the spring is located between the sliding member and the shower head body or between the fixing arm and the shower head body or between the two fixing arms. With reference to the drawings of the description, the spring is provided mainly to ensure that the fixing arm remains in a clamped state without an external force. With reference to FIG. 4, when the spring is located between the sliding member and the shower head body, the spring is provided to ensure that the two fixing arms remain in a folded state all the time without an external force. In other words, after the shower head is fixed to the valve seat assembly, the shower head cannot be taken out from the valve seat assembly without an external force. With reference to FIG. 13, when the spring is located between the fixing arm and the shower head body, the spring is provided to ensure that the two fixing arms remain in a folded state all the time without an external force. In other words, after the shower head is fixed to the valve seat assembly, the shower head cannot be taken out from the valve seat assembly without an external force. With reference to FIG. 12, when the spring is located between the two fixing arms, the two fixing arms are pulled by the spring and will not be unfolded without the actions of an external force and the spring; after the shower head is fixed to the valve seat assembly, the shower head cannot be taken out from the valve seat assembly without an external force.

Specifically, the fixing apparatus further includes a push button 34 for driving the sliding member to move; the push button is cooperatively connected to a linkage member 35; the linkage member is cooperatively connected to the sliding member; and the push button is capable of pushing the sliding member to move. With reference to the drawings of the description, in the present invention, the shower head body includes a hand held portion 21 and a water outlet portion 22, wherein the hand held portion is internally provided with a water channel 23; the fixing apparatus is disposed at the water outlet portion; an opening 24 is formed on the hand held portion; the push button is disposed at the opening; the linkage member is located between the water channel and the hand held portion; the push button is capable of pushing the linkage member to move towards the water outlet portion, such that the sliding member is also driven to move.

Figure 14:
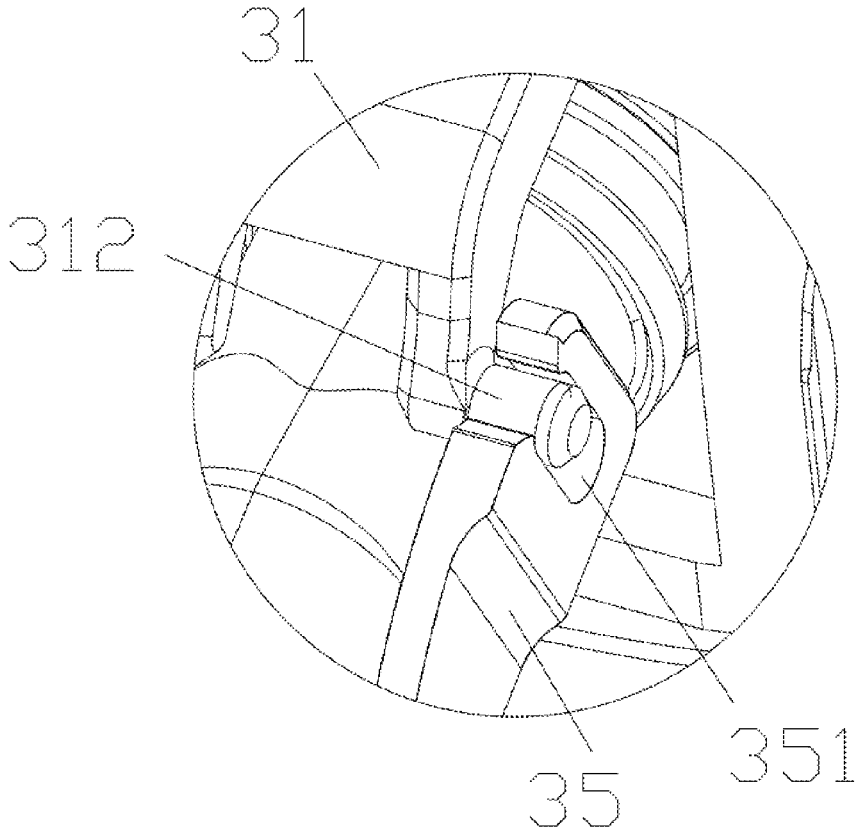
FIG. 14 is an enlarged view of C in FIG. 4.
Figure 15:
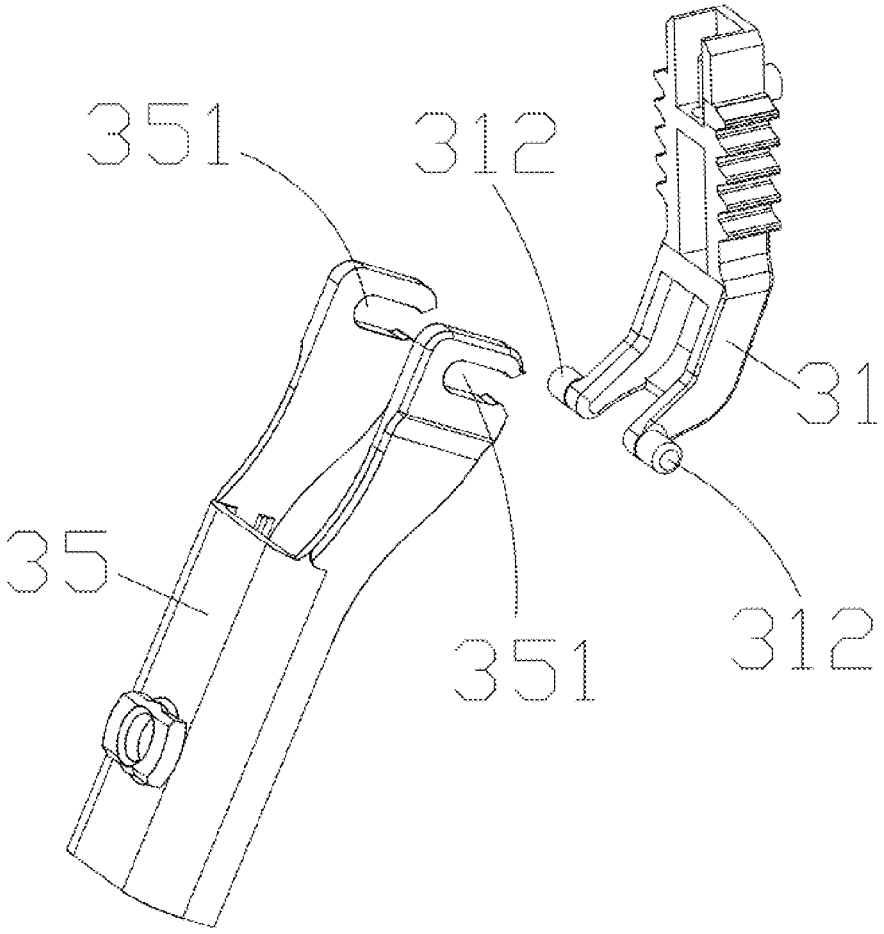
FIG. 15 is a schematic view of a sliding member and a linkage member according to the present invention.

More specifically, as shown in FIGS. 14 and 15, the linkage member 35 is slidably connected to the water channel 23; the push button 34 is firmly connected to the linkage member; a pair of sliding grooves 351 with openings facing the valve seat assembly are disposed at an upper end of the linkage member 35; two sliding bars 312 respectively extending towards two sides are disposed at a lower end of the sliding member 31; the positions of the pair of sliding bars 312 correspond to that of the pair of sliding grooves 351; the pair of sliding bars 312 respectively penetrate through the pair of sliding grooves 351; the sliding bars are in slide fit with the sliding grooves to movably connect the linkage member to the sliding member; when the push button pushes the linkage member to move towards the water outlet portion (namely upwards), the sliding bar moves relative to the sliding groove, then the linkage member drives the sliding member to move upwards, and finally the sliding member drives the two fixing arms to unfold; when the push button pushes the linkage member to move away from the water outlet portion (namely downwards), the sliding bar moves relative to the sliding groove, then the linkage member drives the sliding member to move downwards, and finally the sliding member drives the two fixing arms to fold.

More specifically, the pair of fixing arms are distributed on two sides of the gear rack; a pin shaft 25 is disposed on the shower head body located on two sides of the gear rack; the fixing arm is sleeved on the pin shaft, and rotates around the pin shaft; the push button pushes the sliding member to move; the gear cooperates with the gear rack; the fixing arm rotates around the pin shaft under the action of the pin shaft, so as to fold and unfold the fixing arm; a first guide inclined surface 322 is disposed at one end of the fixing arm distal from the pin shaft; a second guide inclined surface 12 is disposed at one end of the valve seat assembly facing the shower head body; the first guide inclined surface is capable of being cooperatively connected to the second guide inclined surface; when the shower head needs to be fixed on the valve seat assembly, the first guide inclined surface and the second guide inclined surface cooperate to unfold the fixing arms; the spring is compressed until the fixing arms are clamped in the clamping groove; in this case, under the action of the spring, the fixing arms are folded and clamped in the clamping groove, so as to implement the fixed fit between the shower head and the valve seat assembly; when the shower head needs to be removed from the valve seat assembly, the push button is pushed to unfold the two fixing arms and release the fit between the fixing apparatus and the clamping groove, and then the shower head can be removed.

In a preferred use of the present invention, a first magnetic element 41 is disposed on the shower head body; a second magnetic element 42 capable of being cooperatively connected to the first magnetic element is disposed on the valve seat assembly; when the shower head is fixed on the valve seat assembly, the shower head can be more quickly guided in position and clamped on the fixing apparatus under the magnetic cooperation of the two magnetic elements, thereby saving more labor.

In one embodiment of the present invention, the valve seat assembly 10 includes a valve seat 13 and a spherical joint 14 are cooperatively connected; a spherical portion 141 at one end of the spherical joint is cooperatively connected to the valve seat, and a connecting portion 142 at the other end of the spherical joint is provided with a first connecting ring 15 and a second connecting ring 16; the second connecting ring is located between the first connecting ring and the spherical portion; the clamping groove is formed between the first connecting ring and the second connecting ring; the valve seat is cooperatively connected to the spherical joint, such that an angle between the shower head and the valve seat assembly can be adjusted, thereby being applicable to different users. The second guide inclined surface is disposed at one end of the first connecting ring facing the shower head body; and the second magnetic element is disposed in the middle of the first connecting ring.

In a preferred embodiment of the present invention, an insertion hole 26 is disposed on the shower head body; the fixing apparatus is disposed in the insertion hole; the connecting portion of the spherical joint can be inserted into the insertion hole; an outer diameter of the first connecting ring is not greater than a caliber of the insertion hole; the first magnetic element is disposed on a bottom surface of the insertion hole; the shower head is fixed to the valve seat assembly by sleeving in the first connecting ring opposite to the insertion hole of the shower head.

Preferably, a rubber washer 50 is disposed on the periphery of the insertion hole; when the shower head body is fixedly connected to the valve seat assembly, the rubber washer is capable of tightly fitting with the valve seat assembly; the tight fit between the rubber washer and the valve seat assembly improves the friction effect therebetween, thereby not only ensuring that the shower head and the valve seat assembly do not shake, but also having the effect of reducing noises generated under the action of the two magnetic elements.

Still further, the rubber washer includes a rubber ring 51; a connector clip 52 is disposed at one end surface of the rubber ring facing the shower head body; an annular groove 53 is disposed on the connector clip; the connector clip is capable of being inserted into the insertion hole 27 disposed on the shower head body; the annular groove is capable of being clamped on a peripheral wall of the insertion hole; a first inclined surface 54 is disposed at the other end surface of the rubber ring opposite to the shower head body; a second inclined surface 161 capable of tightly fitting with the first inclined surface is disposed on the second connecting ring; in the present invention, after the shower head is fixed to the valve seat assembly, the fixing arm is clamped in the clamping groove, and the first inclined surface tightly fits with the second inclined surface, thereby ensuring the stability of the overall structure.

Figure 16:
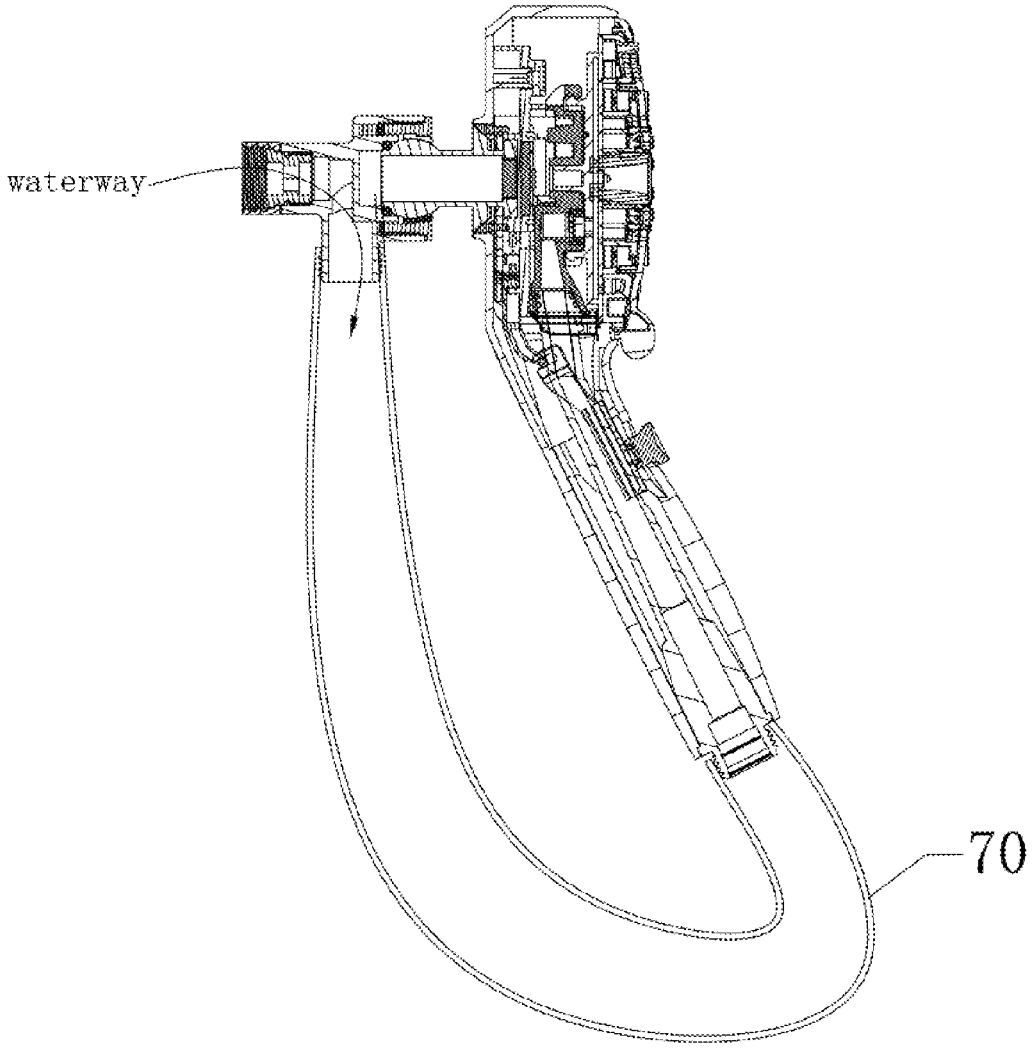
FIG. 16 is a schematic view how a waterway in FIG. 7 is connected to a water channel by means of a connecting pipe.

In a preferred embodiment of the present invention, the valve seat includes a waterway 131 and a mounting space 132 which are not in communication; the spherical portion of the spherical joint is connected to the valve seat by means of an open ring 61 and a lock nut 62; in other words, during use of the present invention, the fixing structure and the shower head do not have water therebetween, and therefore the structure does not have the water leakage phenomenon during use. Preferably, the present invention may be designed as follows: a water flow flows from the waterway to the shower head by means of a connecting pipe 70, and then is then sprayed out, as shown in FIG. 16.

More specifically, the shower head body is further provided with a pair of baffle plates 28 for limiting the positions of the folded fixing arms.

The above descriptions show and describe preferred embodiments of the present invention as described above. It should be understood that the present invention is not limited to the forms disclosed herein. The descriptions should not be regarded as an exclusion of other embodiments, but can be used in various other combinations, amendments and environments, and can be modified within the concept scope of the present invention by means of the above teachings or a technology or knowledge in related art. However, the changes and variations made by a person skilled in the art without departing from the spirit and scope of the present invention should be all concluded in the scope of protection in the claims of the present invention.

What is claimed is:

1. A shower head fixing structure, comprising a valve seat assembly and a shower head body, wherein a clamping groove is disposed on the valve seat assembly; a fixing apparatus clamped with the clamping groove is disposed on the shower head body; the fixing apparatus comprises a sliding member and a fixing arm hinged to the shower head body; a side end of the fixing arm is configured to be clamped in the clamping groove, and a drive end on the other side operates in cooperation with the sliding member; the sliding member is configured to move to drive the fixing arm to rotate, enabling the fixing arm to clamp the shower head body; the fixing apparatus further comprises a spring configured to drive the fixing arm to move towards the clamping groove;

a convex teeth are disposed at an end of the sliding member; a concave teeth are disposed on the fixing arm; the convex teeth and the concave teeth are cooperatively connected; and the convex teeth are configured to move to drive the fixing arm provided with the concave teeth to rotate.

2. The shower head fixing structure as claimed in claim 1, wherein the convex teeth are a gear rack disposed on the sliding member; the concave teeth are a gear disposed on the fixing arm; the gear is fixedly connected to the fixing arm; a center of the gear and a hinge point of the fixing arm are located on a same axial line; the gear rack is cooperatively connected to the gear; and the gear rack is configured to move to drive the fixing arm provided with the gear to rotate.

3. The shower head fixing structure as claimed in claim 1, wherein the spring is located between the sliding member and the shower head body or between the fixing arm and the shower head body or between two fixing arms.

4. The shower head fixing structure as claimed in claim 3, wherein the fixing apparatus further comprises a push button for driving the sliding member to move; the push button is cooperatively connected to a linkage member; the linkage member is cooperatively connected to the sliding member; and the push button is configured to push the sliding member to move.

5. The shower head fixing structure as claimed in claim 4, wherein the fixing arms are a pair; the pair of fixing arms are distributed on two sides of the gear rack; a pin shaft is disposed on the shower head body located on two sides of the gear rack; the fixing arm is sleeved on the pin shaft, and rotates around the pin shaft; a first guide inclined surface is disposed at a side end of the fixing arm distal from the pin shaft; a second guide inclined surface is disposed at an end of the valve seat assembly, wherein the end of the valve seat assembly faces the shower head body; the first guide inclined surface is configured to be cooperatively connected to the second guide inclined surface; a first magnetic element is disposed on the shower head body; and a second magnetic element configured to be cooperatively connected to the first magnetic element is disposed on the valve seat assembly.

6. The shower head fixing structure as claimed in claim 1, wherein the valve seat assembly comprises a valve seat and a spherical joint, wherein the valve seat and the spherical joint are cooperatively connected; a spherical portion at a first end of the spherical joint is cooperatively connected to the valve seat, and a connecting portion at a second end of the spherical joint is provided with a first connecting ring and a second connecting ring; the second connecting ring is located between the first connecting ring and the spherical portion; and the clamping groove is formed between the first connecting ring and the second connecting ring.

7. The shower head fixing structure as claimed in claim 6, wherein the second guide inclined surface is disposed at an end of the first connecting ring, wherein the end of the first connecting ring faces the shower head body; and the second magnetic element is disposed in a middle of the first connecting ring.

8. The shower head fixing structure as claimed in claim 7, wherein an insertion hole is disposed on the shower head body; the fixing apparatus is disposed in the insertion hole; the connecting portion of the spherical joint is configured to be inserted into the insertion hole; an outer diameter of the first connecting ring is smaller than or equal to a caliber of the insertion hole; and the first magnetic element is disposed on a bottom surface of the insertion hole.

9. The shower head fixing structure as claimed in claim 8, wherein a rubber washer is disposed on a periphery of the insertion hole; when the shower head body is fixedly connected to the valve seat assembly, the rubber washer is configured to tightly fit with the valve seat assembly; the rubber washer comprises a rubber ring; a connector clip is disposed at a first end surface of the rubber ring, wherein the first end surface of the rubber ring faces the shower head body; an annular groove is disposed on the connector clip; the connector clip is configured to be inserted into the insertion hole disposed on the shower head body; the annular groove is configured to be clamped on a peripheral wall of the insertion hole; a first inclined surface is disposed at a second end surface of the rubber ring, wherein the second end surface of the rubber ring is opposite to the shower head body; and a second inclined surface configured to tightly fit with the first inclined surface is disposed on the second connecting ring.

10. The shower head fixing structure as claimed in claim 9, wherein the valve seat comprises a waterway and a mounting space, wherein the waterway and the mounting space are not in communication; and the spherical portion of the spherical joint is connected to the valve seat by an open ring and a lock nut.

11. The shower head fixing structure as claimed in claim 4, wherein a pair of sliding grooves with openings facing the valve seat assembly are disposed at an upper end of the linkage member; a pair of sliding bars corresponding to positions of the pair of sliding grooves are disposed at a lower end of the sliding member; and the pair of sliding bars are respectively in slide fit with the pair of sliding grooves.

12. The shower head fixing structure as claimed in claim 1, wherein the spring is located between the sliding member and the shower head body or between the fixing arm and the shower head body or between two fixing arms.

13. The shower head fixing structure as claimed in claim 2, wherein the spring is located between the sliding member and the shower head body or between the fixing arm and the shower head body or between two fixing arms.

14. The shower head fixing structure as claimed in claim 1, wherein the valve seat assembly comprises a valve seat and a spherical joint, wherein the valve seat and the spherical joint are cooperatively connected; a spherical portion at a first end of the spherical joint is cooperatively connected to the valve seat, and a connecting portion at a second end of the spherical joint is provided with a first connecting ring and a second connecting ring; the second connecting ring is located between the first connecting ring and the spherical portion; and the clamping groove is formed between the first connecting ring and the second connecting ring.

15. The shower head fixing structure as claimed in claim 2, wherein the valve seat assembly comprises a valve seat and a spherical joint, wherein the valve seat and the spherical joint are cooperatively connected; a spherical portion at a first end of the spherical joint is cooperatively connected to the valve seat, and a connecting portion at a second end of the spherical joint is provided with a first connecting ring and a second connecting ring; the second connecting ring is located between the first connecting ring and the spherical portion; and the clamping groove is formed between the first connecting ring and the second connecting ring.

16. The shower head fixing structure as claimed in claim 4, wherein the valve seat assembly comprises a valve seat and a spherical joint, wherein the valve seat and the spherical joint are cooperatively connected; a spherical portion at a first end of the spherical joint is cooperatively connected to the valve seat, and a connecting portion at a second end of the spherical joint is provided with a first connecting ring and a second connecting ring; the second connecting ring is located between the first connecting ring and the spherical portion; and the clamping groove is formed between the first connecting ring and the second connecting ring.

17. The shower head fixing structure as claimed in claim 5, wherein the valve seat assembly comprises a valve seat and a spherical joint, wherein the valve seat and the spherical joint are cooperatively connected; a spherical portion at a first end of the spherical joint is cooperatively connected to the valve seat, and a connecting portion at a second end of the spherical joint is provided with a first connecting ring and a second connecting ring; the second connecting ring is located between the first connecting ring and the spherical portion; and the clamping groove is formed between the first connecting ring and the second connecting ring.

* * * * *